US005925602A

United States Patent [19]

Zehler et al.

[11] Patent Number: 5,925,602

[45] Date of Patent: Jul. 20, 1999

[54] SMOKELESS TWO-CYCLE ENGINE LUBRICANTS

[75] Inventors: Eugene R. Zehler, West Chester, Ohio; Bruce J. Beimesch, Crescent Springs, Ky.

[73] Assignee: Henkel Corporation, Gulph Mills, Pa.

[21] Appl. No.: 08/938,490

[22] Filed: Sep. 30, 1997

Related U.S. Application Data

[63] Continuation of application No. 08/679,786, Jul. 15, 1996.
[60] Provisional application No. 60/002,655, Aug. 22, 1995.

[51] Int. Cl.[6] ..... C10M 129/78
[52] U.S. Cl. ..... 508/485; 508/492
[58] Field of Search ..... 508/485, 492

[56] References Cited

U.S. PATENT DOCUMENTS

| | | | |
|---|---|---|---|
| 5,308,524 | 5/1994 | Miyaji et al. | 508/492 |
| 5,372,736 | 12/1994 | Trivett | 508/485 |
| 5,411,672 | 5/1995 | Kagaya et al. | 508/492 |
| 5,503,762 | 4/1996 | Bongardt et al. | 508/492 |
| 5,547,597 | 8/1996 | Koganei et al. | 508/485 |
| 5,560,850 | 10/1996 | Hoppe et al. | 508/485 |
| 5,658,863 | 8/1997 | Duncan et al. | 508/485 |
| 5,681,800 | 10/1997 | Duncan et al. | 508/485 |

*Primary Examiner*—Jacqueline V. Howard
*Attorney, Agent, or Firm*—Wayne C. Jaeschke; John E. Drach; Daniel S. Ortiz

[57] ABSTRACT

Ester base stocks for two-cycle gasoline engine lubricant compositions are disclosed which produce lower amounts of observable smoke in the exhaust emitted as a result of combustion in a two-cycle gasoline engine, require no miscibility-enhancing solvents, have a viscosity of 3.0 cSt to 20.0 cSt at 100° C. and a smoke index of at least 75. Some of the esters are biodegradable.

24 Claims, No Drawings

SMOKELESS TWO-CYCLE ENGINE LUBRICANTS

BENEFIT OF EARLIER FILING DATE UNDER 35 U.S.C. §119(e)

This application claims the benefit of earlier filed and copending provisional application Ser. No. 60/002,655, filed on Aug. 22, 1995. This application is a Continuation of U.S. Ser. No. 08/679,786, filed Jul. 15, 1996, pending.

BACKGROUND OF THE INVENTION

1. Field of the Invention

The present invention relates to two-cycle gasoline engine lubricant compositions and to ester base stocks which are components thereof. The two-cycle gasoline engine lubricants according to the invention produce lower amounts of observable smoke in the exhaust emitted as a result of combustion in a two-cycle gasoline engine, require no miscibility-enhancing solvents and are optionally biodegradable.

2. Description of the Related Art

The two-cycle (two stroke) gasoline engine has gained considerable popularity as a power source for such devices as outboard motors, snow mobiles, motorcycles, mopeds and a variety of landscaping equipment, e.g., lawn mowers, chain saws, string trimmers and blowers. The widespread use of two-cycle gasoline engines is due primarily to their simple design and lightweight construction, their ability to provide high power output with quick starts at low temperature and their relatively low cost.

Two-cycle gasoline engines are operated using a mixture of gasoline and a lubricant in prescribed proportions. Because the fuel contains a gasoline-lubricant mixture, large amounts of smoke are generated and emitted in the exhaust. The lubricant must provide satisfactory performance characteristics under severe operating conditions. Lubricants for two-cycle gasoline engines are generally composed of a mineral oil or synthetic base fluid, performance additive(s) and a solvent, ordinarily a relatively low boiling petroleum distillate, to enhance gasoline/lubricant miscibility.

The technologies developed to date for reducing exhaust emissions from four-cycle car and truck gasoline engines have not been successfully adapted to two-cycle gasoline engines. Hence, there is growing public concern over the high levels of hydrocarbon emissions from these small gasoline engines, as hydrocarbons do not readily biodegrade.

The hydrocarbon emissions are a consequence of the basic design of the gasoline engine. Specifically, in the power stroke of a typical two-cycle gasoline engine, air, oil and fuel are drawn into the crank case as the combined charge is compressed in the space above the piston. In the exhaust stroke, the burnt gases are discharged through exhaust ports, and a fresh combustible charge is transferred from the crank case to the space above the piston. Because the exhaust ports open before and close after transfer of the fresh combustible charge occurs, as much as 20% of the fresh charge will be discharged unburnt with the exhaust. Consequently, hydrocarbon emissions far exceed the level of emissions from a comparable four-cycle engine.

Water-cooled outboard motors exhaust directly into the water, giving rise to water pollution, whereas the other devices mentioned above, which are equipped with air-cooled two-cycle gasoline engines, produce emissions that pose a serious air pollution problem. For example, the California Air Research Board has determined that many two-cycle gasoline engines produce up to fifty times the pollution of truck engines per horsepower hour.

Visible smoke emissions in the exhaust from two-cycle gasoline engines has also recently come under increased scrutiny and regulation. In addition, smoky emissions from two-cycle gasoline engines are also becoming a problem from an aesthetic stand point.

The above-noted pollution and smoke problems are exacerbated by the presence of volatile organic solvents in the lubricant. Moreover, some of the solvents used as miscibility enhancers, such as Stoddard solvent, have relatively low flash points, thus creating a potential fire risk, which is of particular concern in connection with the storage and transportation of such products.

Thus, a need has existed for a two-cycle gasoline engine lubricant composition which is formulated so as to prevent pollution by protecting against emission of harmful hydrocarbons into the environment, and to reduce the hazard potential of the solvent-containing lubricants, and to at least minimize smoky emissions. These objectives must be obtained, however, while simultaneously satisfying stringent performance standards, e.g., good lubricity and detergency, particularly on piston rings, superior anti-seizure properties and high gel/floc resistance, and providing optimum miscibility of lubricant and fuel over the applicable range of operating conditions.

SUMMARY OF THE INVENTION

Certain types of esters are useful as base stocks for a two-cycle gasoline engine lubricants. These esters generate reduced amounts of observable smoke as a result of combustion in a two-cycle gasoline engine. The ester base stocks according to the invention are described herein below.

The two-cycle gasoline engine base stocks and lubricant compositions of the invention are useful in both water-cooled and air-cooled two-cycle gasoline engines. The lubricant compositions of the invention can be formulated to be free of conventional solvents, thereby substantially reducing not only the pollution potential of two-cycle gasoline engines lubricated therewith, but the hazard risk inherent in solvent-containing formulations.

The two-cycle gasoline engine lubricant compositions of the invention are composed of the ester base stocks as described herein and any of the performance additive packages known in the art, such as detergent/dispersant additives, extreme pressure additives, anti-foaming agents, pour point depressants, rust or corrosion prevention agents and, oxidation inhibitors. The ester base stocks according to the invention typically have a flash point of at least about 100° C. as determined under ASTM D-92, a kinematic viscosity in the range of from 3.0 cSt to 20.0 cSt at 100° C. as determined under ASTM D-445, and a pour point of less than about 0° C. as determined under ASTM D-97. The base stocks according to the invention will exhibit excellent miscibility with gasoline, in fuel/lubricant volume ratios between 10:1 to 300:1. Some of the base stocks according to the invention are also biodegradable as determined by Coordinating European Counsel standard test method L-33-A-94 (Biodegradability of Two-Stroke Cycle Outboard Gasoline engine Oils in water, abbreviated C.E.C. L-33-A-94), the most commonly used biodegradability test for two-cycle engine lubricants.

The ester base stocks according to the invention will also be useful in the next generation of two-cycle engines. Lubricants used in present day two-cycle engines are contained in a mixture with gasoline in prescribed proportions. The mixture itself is fed directly into the combustion chambers of the engine. As stated previously, because the fuel contains a gasoline-lubricant mixture, large amounts of smoke are other pollutants are generated and emitted in the exhaust. In future two-cycle engines, metered amounts of gasoline and lubricant will be fed into the combustion chambers separately so that the amount of the lubricant can vary in response to the lubrication requirements at any given time. For example, more lubricant will be introduced into a cold engine at start-up whereas a relatively lower amount of lubricant will be fed to an engine running at higher operating temperatures. Overall, less lubricant will be used resulting in reduced amounts of smoke and pollutants emitted into the atmosphere.

DESCRIPTION OF THE PREFERRED EMBODIMENTS

Other than in the claims and in the operating examples, or where otherwise indicated, all numbers expressing quantities of ingredients or reaction conditions used herein are to be understood as modified in all instances by the term "about".

It is understood that some of the carbon chain lengths of the carboxylic acids and/or esters disclosed herein are average numbers. This reflects the fact that some of the carboxylic acids and/or esters are derived from naturally occurring materials and therefore contain a mixture of compounds the major component of which is the stated compound. For example, a carboxylic having 12 carbon atoms derived from coconut oil is composed primarily of from 45% to 55% by weight of a $C_{12}$ carboxylic acid, from 15% to 23% by weight a $C_{14}$ carboxylic acid, from 8% to 11% by weight of a $C_{16}$ carboxylic acid, from 1% to 10% by weight of a $C_{18}$ carboxylic acid, from 1% to 14% by weight of a combination of $C_8$ and $C_{10}$ carboxylic acids, and from 1% to 8% by weight of a $C_{18:1}$ carboxylic acid.

The term smokeless as used herein refers to a smoke index rating of at least 75 in the JASO M 342-92 test, the published test procedure of which is incorporated herein by reference.

The surprising discovery has been made that certain types of esters are useful as base stocks for lubricants that generate reduced amounts of observable smoke as a result of combustion in a two-cycle gasoline engine.

The ester base stocks according to the invention fall into two general categories. These are: (1) a mixture of two esters wherein the first ester has a viscosity 2 cSt or less at 100° C.; a flash point 200° C. or less (Cleveland Open Cup); and 20 or fewer carbon atoms and the second ester has a viscosity such that when it is mixed with the first ester the resulting mixture has a viscosity of from 3.0 cSt to 20.0 cSt at 100° C. as determined under ASTM D-445 and a smoke index of at least 75 as determined by the JASO M 342-92 test; (2) one or more complex esters selected from the group consisting of: (a) linear oligoesters having a molecular weight of 3000 Daltons or less; (b) a complex, non-hindered polyester wherein the polyol component is a molecule having one or more beta hydrogen atoms; (c) a complex, non-hindered polyester wherein the polyol component is a non-hindered polyol having at least 3 OH groups; (d) an ester wherein the polyol component is a hindered polyol and the carboxylic acid components is a mono-carboxylic acid or a polycarboxylic acid and mixtures thereof.

The ester mixture which is the first type of ester base stock according to the invention can be any combination of at least two esters. The first ester is characterized as one or more esters having a viscosity of 2 cSt or less at 100° C.; a flash point 200° C. or less (Cleveland Open Cup); and 20 or fewer carbon atoms. Examples of such esters include but are not limited to isodecyl nonanoate and methyl octadecenoate (methyl oleate). The second ester is characterized as one or more esters having a viscosity such that when it is mixed with the first ester the resulting mixture has a viscosity of from 3.0 cSt to 20.0 cSt at 100° C. as determined under ASTM D-445 and a smoke index of at least 75 as determined by the JASO M 342-92 test. The second type of ester can be any ester that will form a mixture having a viscosity of from 3.0 cSt to 20.0 cSt at 100° C. and a smoke index of at least 75 as described above. Such esters can be simple esters or complex esters. Simple esters are esters of monools and mono-carboxylic acids while complex esters can be polyol esters such as pentaerythritol tetra octadecenoate or polymeric esters such as linear oligoesters having a molecular weight of 3000 Daltons or less; complex, non-hindered polyesters wherein the polyol component is a molecule having one or more beta hydrogen atoms; complex, non-hindered polyesters according to the invention are those containing a non-hindered polyol having at least 3 OH groups; and/or esters wherein the polyol component is a hindered polyol and the carboxylic acid component is a mono-carboxylic acid or a polycarboxylic acid. The ester mixture can contain more than two esters as long as the resulting mixture has a viscosity of from 3.0 cSt to 20.0 cSt at 100° C. and a smoke index of at least 75. Preferred ester mixtures are listed in Table 1 below.

The second general category is comprised of four types of complex esters. This group is comprised of one or more of: (a) linear oligoesters having a molecular weight of 3000 Daltons or less; (b) complex, non-hindered polyesters wherein the polyol component is a molecule having one or more beta hydrogen atoms; (c) complex, non-hindered polyester according to the invention are those containing a non-hindered polyol having at least 3 OH groups; (d) esters wherein the polyol component is a hindered polyol and the carboxylic acid component is a mono-carboxylic acid or a polycarboxylic acid and mixtures of (a) through (d).

The first type of complex ester includes linear oligoesters having a molecular weight of 3000 Daltons or less. The oligomers according to the invention can be comprised of any combination of difunctional alcohols and dicarboxylic acids and also containing either a monool or a monocarboxylic acid as a chain stopper. Such oligomers can be made by the classical condensation or step-growth polymerization methods well known to those skilled in the art and described, for example, in pages 69–105 of The Principles of Polymer Chemistry, P. J. Flory, Cornell University Press, 1953. Preferred oligomers include the oligoester comprised of dipropylene glycol-azelaic acid-isononanoic acid; the oligoester comprised of dipropylene glycol-adipic acid-isononanoic acid; and the oligoester comprised of dipropylene glycol-azelaic acid-2-ethylhexanol. Most preferred oligomers are the oligoester comprised of dipropylene glycol-azelaic acid-nonanoic acid (mole ratio 2/1/2 respectively); the oligoester comprised of dipropylene glycol-adipic acid-nonanoic acid (mole ratio 2/1/2 respectively); and the oligoester comprised of diethylene glycol-azelaic acid-nonanoic acid (mole ratio 2/1/2 respectively).

The second type of complex ester includes complex, non-hindered polyesters. Non-hindered polyesters are those in which the polyol component is a molecule having one or more beta hydrogen atoms. A beta hydrogen atom is a hydrogen atom bonded to a carbon atom which is adjacent to a carbon atom bonded to a functional group. In the case of a polyol, a beta hydrogen is a hydrogen atom bonded to a carbon atom which is adjacent to a carbon atom bonded to an alcohol functionality. An example of a polyol having two beta hydrogen atoms is 1,3-propanediol. Glycerol is an example of a polyol having a total of five beta hydrogen atoms. Trimethylolpropane, on the other hand, has no beta hydrogen atoms. One type of complex, non-hindered polyester according to the invention are those containing a non-hindered polyol having at least 3 OH groups, a polycarboxylic acid having at least 2 carboxyl groups and a mono-carboxylic acid. The polyol/polycarboxylic acid mole ratio is equal to from about 0.1/1.0 to about 4/1.2 and the polymer chains are terminated with mono-carboxylic acids which are used as chain stoppers. Preferred complex, non-hindered polyesters of this type are those containing glycerin as the non-hindered polyol having at least 3 OH groups, adipic acid as the polycarboxylic acid having at least 2 carboxyl groups and heptanoic acid as the mono-carboxylic acid.

The third type of complex ester includes complex, non-hindered polyesters. Non-hindered polyesters are those which are comprised of a polyol component which is non-hindered polyol having at least 3 OH groups, a polycarboxylic acid component which is a polycarboxylic acid having at least 2 carboxyl groups, a monocarboxylic acid component and a monool component. The polyol/polycarboxylic acid mole ratio is equal to from about 0.1/1.0 to about 1/1 and the polymer chains are terminated with monools and mono-carboxylic acids which are used as chain stoppers. Preferred complex, non-hindered polyesters of this type are those containing glycerin as the non-hindered polyol having at least 3 OH groups, adipic acid as the polycarboxylic acid having at least 2 carboxyl groups and nonanoic acid and octanol as the mono-carboxylic acid and monool chain terminators. Preferred non-hindered polyol having at least 3 OH groups are those having from 3 to 10 carbon atoms. Preferred polycarboxylic acid having at least 2 carboxyl groups are those having from 2 to 54 carbon atoms. Preferred mono-carboxylic acid chain stopper are those having from 5 to 20 carbon atoms. Preferred monool chain stoppers are those having from 2 to 20 carbon atoms. Particularly preferred complex, non-hindered polyesters include such oligoesters those comprised of glycerine-adipic acid-nonanoic acid/octanol (mole ratio—1/2/1/2) and glycerine-adipic acid-heptanoic acid/hexanol (mole ratio—1/2/1/2).

The fourth type of complex ester includes esters wherein the polyol component is a hindered polyol and the carboxylic acid component is a mono-carboxylic acid or a polycarboxylic acid. Preferred esters of this type include dipentaerythritol ester of pentanoic acid, trimethylolpropane-isotridecanol-adipic acid, and trimethylolpropane tristearate.

It is also within the present invention to use a single ester as the base stock for the lubricants according to the invention. In the case of such a single component system, the ester will have a smoke index of greater than 75 but may have a viscosity below 2 cSt at 100° C. which may be below the viscosity requirements for 2-cycle engines. Examples of such esters are isononyl isononanoate, dimethyl azelate and polyol esters of monocarboxylic acids such as glyceryl triisostearate and glyceryl trioctadecenoate.

Various detergent/dispersant additive packages may be combined with the above-described ester base stocks in formulating the two-cycle oil compositions of the invention. Ashless or ash-containing additives may be used for this purpose.

Suitable ashless additives include polyamide, alkenylsuccinimides, boric acid-modified alkenylsuccinimides, phenolic amines and succinate derivatives or combinations of any two or more of such additives.

Polyamide detergent/dispersant additives, such as the commonly used tetraethylenepentamine isostearate, may be prepared by the reaction of fatty acid and polyalkylene polyamines, as described in U.S. Pat. No. 3,169,980, the entire disclosure of which is incorporated by reference in this specification, as if set forth herein in full. These polyamides may contain measurable amounts of cyclic imidazolines formed by internal condensation of the linear polyamides upon continued heating at elevated temperature. Another useful class of polyamide additives is prepared from polyalkylene polyamines and $C_{19}$–$C_{25}$ Koch acids, according to the procedure of R. Hartle et al., JAOCS, 57 (5): 156–59 (1980).

Alkenylsuccinimides are formed by a step-wise procedure in which an olefin, such as polybutene ($\overline{MW}$ 1200) is reacted with maleic anhydride to yield a polybutenyl succinic anhydride adduct, which is then reacted with an amine, e.g., an alkylamine or a poly-amine, to form the desired product.

Phenolic amines are prepared by the well-known Mannich reaction (C. Mannich and W. Krosche, Arch. Pharm., 250: 674 (1912)), involving a polyalkylene-substituted phenol, formaldehyde and a polyalkylene polyamine.

Succinate derivatives are prepared by the reaction of an olefin (e.g., polybutene (eg., polybutene) and maleic anhydride to yield a polybutenyl succinic anhydride adduct, which undergoes further reaction with a polyol, e.g., pentaerythritol, to give the desired product.

Suitable ash-containing detergent/dispersant additives include alkaline earth metal (e.g., magnesium, calcium, barium), sulfonates, phosphonates or phenates or combinations of any two or more of such additives.

The foregoing detergent/dispersant additives may be incorporated in the lubricant compositions described herein in an amount from about 1 to about 25%, and more preferably from about 3% to about 20% based on the total weight of the composition.

Various other additives may be incorporated in the lubricant compositions of the invention, as desired. These include smoke-suppression agents, such as polybutene or polyisobutylene, extreme pressure additives, such as dialkyldithiophosphoric acid salts or esters, anti-foaming agents, such as silicone oil, pour point depressants, such as polymethacrylate, rust or corrosion prevention agents, such as triazole derivatives, propyl gallate or alkali metal phenolates or sulfonates, oxidation inhibitors, such as substituted diarylamines, phenothiazines, hindered phenols, or the like. Certain of these additives may be multifunctional, such as polymethacrylate, which may serve as an anti-foaming agent, as well as a pour point depressant. Volatile, combustible solvent such as kerosene or Stoddard solvent can also be used as additives. Stoddard solvent is defined according to ASTM D-484-52 as a petroleum distillate having a minimum flash point of 100° F., a distillation range of 50% over at 350° F., 90% over at 375° F., an end point below 450° F. and an autoignition temperature of 450° F. Volatile, combustible solvents may be added to any type of ester in order to bring the smoke index to a value of at least 75 in the JASO M 342-92 test and/or to improve the compatibility and/or solubility of other additives and to improve the low temperature characteristics such as viscosity and gasoline miscibility.

Commercially available two-cycle lubricant additive packages may be used in combination with esters according to the invention such as, for example, LUBRIZOL® 400, ORONITE® OLOA 340A (Chevron), LUBRIZOL® 6827, LUBRIZOL® 6830, LUBRIZOL® 600, LUBRIZOL® 606, ORONITE® OLOA 9333 (Chevron), and ORONITE® OLOA 9357 (Chevron).

Most of the above-described additives may be incorporated in the lubricant composition in an amount from about 0.01% to about 15%, and preferably from about 0.01% to about 6%, based on the total weight of the lubricant composition. In the case of polybutene, the amount may vary from 1% to 50%. The amount selected within the specified range should be such as not to adversely effect the desirable performance properties of the lubricant. The effects produced by such additives can be readily determined by routine testing.

The two-cycle gasoline engine lubricant compositions of the present invention would be particularly suited, when mixed with an appropriate fuel, for operating outboard motors, snow mobiles, motorcycles, mopeds, lawn mowers, chain saws, string trimmers and the like.

The following examples are meant to illustrate but not to limit the invention.

EXAMPLE 1

Preparation of Trimethylolpropane Triisononanoate 691 grams (5.16 moles) of trimethylolpropane, 2809 grams (17.78 moles) of isononanoic acid were combined in the reactor and heated to about 230° C. to carry-out the esterification of the ingredients. After the water of reaction which is continually removed began to slow at 230° C. about 26" of vacuum was added to assist in the dehydration of the ester. After four and a half hours of reaction time had passed, the temperature was about 235° C. and the analysis of the ester was an Acid Value (AV) of 48.4 and Hydroxyl Value (OH) of 24.5. After six hours of reaction time had passed, analysis of the reaction mix was made and showed the AV=41.8 and OH=5.14. After six hours of reaction time the contents were stripped and then filtered to isolate the crude ester product. The product was caustic refined (NaOH), and dried and filtered to yield the finished ester with the following properties:

| | |
|---|---|
| Acid Value, mgs KOH/gm of sample | 0.05 |
| Hydroxyl Value, mgs KOH/gm of sample | 2.15 |
| Viscosity at 40° C., centistokes | 52.79 |
| Viscosity at 100° C., centistokes | 7.13 |
| Viscosity Index | 91 |
| Flash Point, ° F. | 450 |
| Fire Point, ° F. | 525 |
| Cloud Point, ° F. | clear at pour point |
| Pour Point, ° F. | −35 |

EXAMPLE 2

Preparation of Trimethylolpropane Tristearate

The preparation of trimethylolpropane tristearate was carried out by reacting 1800 grams (1.00 equivalents) of stearic acid with 300 grams (1.035 equivalents) of trimethylolpropane. There was a slight excess of the polyol used to drive this reaction because of the difficulty in removing the high molecular weight stearic acid by vacuum stripping. The reaction vessel was equipped as described in Example 5 and the reaction was successfully carried out at 240–260° C. Water of reaction was removed and high vacuum was used to help drive the reaction to completion. The crude ester had an acid value of 2.1 and hydroxyl value of less than 14. The crude ester was refined using a chemical treatment of Cardura E which is a glycidyl ester. About 12 grams of Cardura E were added to the crude ester at 239° C. and held for 2 hours. The excess Cardura E was stripped at 239° C. for about 1 hour. The product was cooled and filtered. The final ester properties were as follows:

| Trimethylolpropane tristearate | |
|---|---|
| Acid Value | 0.085 |
| Hydroxyl Value | 9.92 |
| Viscosity at 100° C., cst. | 11.67 |
| Pour Point, ° F. | solid at room temperature |
| Flash Point, ° F. | 600 |
| Fire Point, ° F. | 645 |
| Color % Transmission 440/550 nm. | 76/96 |

EXAMPLE 3

Preparation of Di-isotridecyltrimethyladipate

Di-isotridecyltrimethyladipate was prepared by reacting 986 grams (1.00 equivalents) of trimethyladipic acid with 2414 grams (1.15 equivalents) of isotridecyl alcohol. The vessel was similar to that previously described. The reaction was carried out at 225–230° C. while removing water of reaction. When the rate of water of removal slowed, low vacuum the applied to help continue the reaction to an acid value of 10.9. The ester was then slowly stripped of excess alcohol by applying full vacuum of about 2 Torr. The crude ester had an acid value of 6.2 and hydroxyl value of 2.0. The crude ester was then alkali refined and filtered to yield the following finished ester properties:

| di-isotridecyltrimethyladipate | |
|---|---|
| Acid Value | 0.016 |
| Hydroxyl Value | 5.21 |
| Viscosity at 40° C., cst. | 36.96 |
| Viscosity at 100° C., cst. | 5.95 |
| Viscosity Index | 104 |
| Pour Point, ° F. | −50 |
| Flash Point, ° F. | 465 |
| Fire Point, ° F. | 520 |
| Color % Transmission at 440/550 nm. | 5/45 |

EXAMPLE 4

Preparation of Isononylisononanoate

The preparation of isononylisononanoate was carried out by charging 1660 grams (1.00 equivalents) isononanoic acid and 1740 grams (1.15 equivalents) of isononyl alcohol into a 5-liter 4-neck glass reaction vessel. The vessel is equipped with agitation and a column to condense and remove water of reaction while returning the excess alcohol back to the reaction vessel. The reaction was carried out at about 230° C. until the acid value of the preparation was a 5.0 and then the ester was stripped of excess alcohol until the hydroxyl value was 0.7. The crude ester at this point had an acid value of 1.5. The crude ester was alkali refined with NaOH to remove the trace amounts of acidity and then filtered through a filter aid. The final analysis is as follows:

| Isononylisononanoate | |
|---|---|
| Acid Value | 0.006 |
| Hydroxyl Value | 0.84 |
| Viscosity at 40° C., cst. | 4.61 |
| Viscosity at 100° C., cst. | 1.64 |
| Viscosity at −40° C., cst. | 221 |
| Pour Point, ° F. | <−95 |
| Flash Point, ° F. | 310 |
| Fire Point, ° F. | 340 |
| Color % Transmission at 440/550 nm. | 100/100 |

EXAMPLE 5

Preparation of a Complex, Non-Hindered Polyester

A 5-liter, 4-neck glass reaction vessel equipped with agitation and a column to condense and remove water of reaction while returning the excess alcohol back to the reaction vessel and a nitrogen inlet were charged with 160.2 grams of glycerine (1.74 moles), 508.5 grams of adipic acid (3.48 moles), 278.6 grams of pelargonic acid (1.76 moles) and, 452.7 grams of octyl alcohol (4.00 moles). The contents of the flask were heated to 230° C. and water was removed until the acid number reached 7.3 and the hydroxyl number reached 7.1. The reaction product was alkali-refined to decrease the acid number to 0.31. The final product specs were: acid number 0.31; hydroxyl number—10.46; visc. @ 40° C.—52.56 cSt; visc. @ 100C.—10.26 cSt; Viscosity Index—187; Flash Point—210° C.; Fire Point—224° C.; Pour Point—21° C.

EXAMPLE 6

Preparation of a Linear Oligoester

A 5-liter, 4-neck glass reaction vessel equipped with agitation and a column to condense and remove water of reaction while returning the excess alcohol back to the reaction vessel and a nitrogen inlet were charged with 480 grams of dipropylene glycol (3.58 moles), 344.6 grams of azelaic acid (1.83 moles). The contents of the flask were heated to 225° C. and water was removed until the acid number reached 4.8 and the hydroxyl number reached 59.2 at which time 660.6 grams of pelargonic acid (4.17 moles) were added and the heating and water removal were continued until acid number reached 28.4 and the hydroxyl number reached 8.4. Excess acid and water were removed until the acid number reached 7.2 and the hydroxyl number reached 6.7. The reaction product was alkali-refined to decrease the acid number to 0.10. The final product specs were: acid number—0.10; hydroxyl number—9.95; visc. @ 40° C.—41.28 cSt; visc. @ 100° C.—8.08 cSt; Viscosity Index—173; Flash Point—252° C.; Fire Point—263° C.; Pour Point—54° C.

TABLE 1

| I.D.[1] | Visc.[2] | Pour Point[3] (° C.) | Flash Point[4] (° C.) | Smoke Index[5] | Biodegr[6] |
|---|---|---|---|---|---|
| 2911 | 1.7 | −73 | 171 | 74 | >95 |
| 2873 | 160 | −9 | 293 | 81 | 60 |
| 2873/2911 (33/67) | 7.9 | −59 | 168 | 120 | 69 |
| 2301 | 1.7 | −18 | 182 | 78 | >95 |
| 2873/2301 (34/66) | 8 | −23 | 182 | 92 | |

TABLE 1-continued

| I.D.[1] | Visc.[2] | Pour Point[3] (° C.) | Flash Point[4] (° C.) | Smoke Index[5] | Biodegr[6] |
|---|---|---|---|---|---|
| 2898 | 12.4 | −23 | 320 | 90 | >95 |
| 2898/2911 (79/21) | 8 | −37 | 199 | 92 | |
| 2898/2301 (80/20) | 8 | −34 | 210 | 86 | |
| 3528-8 | 1.6 | −73 | 154 | 176 | |
| 2898-3528-8 (79/21) | 8 | −32 | 199 | 105 | |
| 2983 | 223 | −18 | 243 | 39 | 73 |
| 2983/2911 (27/73) | 8 | −62 | 182 | 86 | |
| 2983-3528-8 (27/73) | 8 | −62 | 157 | 180 | |
| 2914 | 1.2 | −7 | 149 | 181 | |
| 2983/2914 (30/70) | 8 | −5 | 146 | 209 | |
| 3588-4 | 9.3 | −43 | 218 | 86 | |
| 3588-9 | 8.5 | −37 | 224 | 77 | |
| 3588-13 | 7.4 | −15 | 243 | 91 | |
| 3588-19 | 9.2 | −48 | 252 | 90 | >95 |
| 3588-33 | 10.3 | −21 | 210 | 108 | |
| 3589-1A | 8 | −59 | 185 | 113 | 91 |
| 3589-1B | 8 | −23 | 188 | 88 | |
| TMP-05-320 | 44.5 | −34 | 332 | 92 | 91 |
| 3528-61 | 8.1 | −54 | 252 | 90 | >95 |
| 3528-69 | 6.9 | −65 | 252 | 72 | |
| 3528-76 | 7.1 | −51 | 249 | 85 | >95 |
| 3528-79 | 7.4 | −48 | 254 | 54 | |

[1]—2911 — isodecyl nonanoate
2873 — dimer acid ester of diethylene glycol
2301 — methyl octadecenoate
2898 — pentaerythritol tetra octadecenoate
3528-8 — isononyl isononanoate
2914 — dimethyl azelate
2983 — dimer acid ester of neopentylglycol and propylene glycol
3588-4 — oligoester of dipropylene glycol-azelaic acid-isononanoic acid (mole ratio-2/1/2)
3588-9 — oligoester of dipropylene glycol-adipic acid-isononanoic acid (mole ratio-2/1/2)
3588-13 — oligoester of diethylene glycol-azelaic acid-nonanoic acid (mole ratio-2/1/2)
3588-19 — oligoester of glycerine-adipic acid-heptanoic acid (mole ratio-2/1/4)
3588-33 — oligoester of glycerine-adipic acid-nonanoic acid/octanol (mole ratio-1/2/1/2)
3589-1A — TMP-05-320/2911 (48/52)
3589-1B — TMP-05-320/2301 (49/51)
TMP-05-320 — complex ester trimethylolpropane-dimer acid-octadecenoic acid
3528-61 — oligoester of dippropylene glycol-azelaic acid-nonanoic acid (mole ratio-2/1/2)
3528-69 — oligoester of dippropylene glycol-azelaic acid-2-ethylhexanol (mole ratio-1/2/2)
3528-76 — oligoester of dippropylene glycol-adipic acid-nonanoic acid (mole ratio-2/1/2)
3528-79 — oligoester of dippropylene glycol-adipic acid-isodecyl alcohol (mole ratio-1/2/2)
[2]—ASTM D-445 (cSt. @ 100° C.)
[3]—ASTM D-97
[4]—ASTM D-92
[5]—JASO M-342-92
[6]—C.E.C L-33-A-94

What is claimed is:

1. An ester base stock for a smokeless two cycle engine lubricant comprising: at least one linear oligoester having a molecular weight of 3000 Daltons or less containing residues of a non-hindered, unbranched diol containing from 4 to 6 carbon atoms, residues of a dicarboxylic acid containing from 6 to 36 carbon atoms and optionally residues of at least one member selected from the group consisting of monocarboxylic acids and monools each having from 7 to 10 carbon atoms wherein the base stock has a smoke index of at least 75.

2. The ester base stock of claim 1 wherein said base stock comprises an oligoester comprised of dipropylene glycol, azelaic acid and nonanonic acid residues wherein the base stock has a viscosity of from 3 cSt to 20 cSt at 100° C.

3. The ester base stock of claim 1 wherein said base stock comprises an oligoester comprised of dipropylene glycol, adipic acid and nonanoic acid residues wherein the base stock has a viscosity of from 3 cSt to 20 cSt at 100° C.

4. The ester base stock of claim 1 wherein said base stock comprises an oligoester comprised of diethylene glycol, azelaic acid and nonanoic acid residues and wherein the base stock has a viscosity of from 3 cSt to 20 cSt at 100° C.

5. The ester base stock of claim 1 wherein said oligoester comprises dimer acid residues and diethylene glycol residues.

6. The ester base stock of claim 1 further comp rising an additive selected from the group consisting of extreme pressure additives, anti-foaming agents, pour point depressants, rust or corrosion prevention agents, oxidation inhibitors, detergent, dispersants, smoke-suppression agents, hydrocarbon diluents.

7. A method for eliminating or reducing observable smoke in an exhaust emitted from a two-cycle gasoline engine which comprises: bringing the components of said engine, which are to be lubricated, into contact with an effective amount of a lubricant comprising at least one linear oligoester having a molecular weight of 3000 Daltons or less containing residues of a non-hindered, unbranched diol containing from 4 to 6 carbon atoms, residues of a dicarboxylic acid containing from 6 to 36 carbon atoms and optionally residues of at least one member selected from the group consisting of monocarboxylic acids and monools each having from 7 to 10 carbon atoms wherein the base stock has a smoke index of at least 75.

8. The method of claim 7 wherein said base stock comprises an oligoester comprised of dipropylene glycol, azelaic acid and nonanonic acid residues and wherein the base stock has a viscosity of from 3 cSt to 20 cSt at 100° C.

9. The method of claim 7 wherein said base stock comprises an oligoester comprised of dipropylene glycol, adipic acid and nonanoic acid residues and wherein the base stock has a viscosity of from 3 cSt to 20 cSt at 100° C.

10. The method of claim 7 wherein said base stock comprises an oligoester comprised of diethylene glycol, azelaic acid and nonanoic acid residues and wherein the base stock has a viscosity of from 3 cSt to 20 cSt at 100° C.

11. The method of claim 7 wherein said oligoester comprises a dimer acid ester of diethylene glycol.

12. The method of claim 7 further comprising an additive selected from the group consisting of extreme pressure additives, anti-foaming agents, pour point depressants, rust or corrosion prevention agents, oxidation inhibitors, detergent, dispersants, smoke-suppression agents, hydrocarbon diluents.

13. In a two-cycle internal combustion engine comprising lubricant, the improvement wherein said lubricant comprises at least one linear oligoester having a molecular weight of 3000 Daltons or less containing residues of a non-hindered, unbranched diol containing from 4 to 6 carbon atoms, residues of a dicarboxylic acid containing from 6 to 36 carbon atoms and optionally residues of at least one member selected from the group consisting of monocarboxylic acids and monools each having from 7 to 10 carbon atoms wherein the base stock has a smoke index of at least 75.

14. The two-cycle engine of claim 13 wherein said base stock comprises the oligoester comprised of dipropylene glycol, azelaic acid and nonanonic acid residues wherein the base stock has a viscosity of from 3 cSt to 20 cSt at 100° C.

15. The two-cycle engine of claim 13 wherein said base stock comprises the oligoester comprised of dipropylene glycol, adipic acid and nonanoic acid residues wherein the base stock has a viscosity of from 75-3 cSt to 20 cSt at 100° C.

16. The two-cycle engine of claim 13 wherein said base stock comprises the oligoester comprised of diethylene glycol, azelaic acid and nonanoic acid residues and wherein the base stock has a viscosity of from 3 cSt to 20 cSt at 100° C.

17. The two-cycle engine of claim 13 wherein said oligoester comprises the dimer acid ester of diethylene glycol.

18. The 2-cycle engine of claim 13 further comprising an additive selected from the group consisting of extreme pressure additives, anti-foaming agents, pour point depressants, rust or corrosion prevention agents, oxidation inhibitors, detergent, dispersants, smoke-suppression agents, hydrocarbon diluents.

19. An ester base stock for a somkeless two-cycle engine lubricant which is a product of a process comprising: reacting a dicarboxylic acid having from 6 to 36 carbon atoms with a non-hindered, unbranched diol having from 4 to 6 carbon atoms optionally in the presence of a monocarboxylic acid or a monool each having from 7 to 10 carbon atoms to form a linear oligoester having a molecular weight of 3000 Daltons or less and a smoke index of at least 75.

20. The ester base stock of claim 19 wherein said base stock comprises the oligoester comprised of dipropylene glycol, azelaic acid and nonanonic acid residues wherein the base stock has a viscosity of from 3 cSt to 20 cSt at 100° C.

21. The ester base stock of claim 19 said base stock comprises the oligoester comprised of dipropylene glycol, adipic acid and nonanoic acid residues wherein the base stock has a viscosity of from 3 cSt to 20 cSt at 100° C.

22. The ester base stock of claim 19 wherein said base stock comprises the oligoester comprised of diethylene glycol, azelaic acid and nonanoic acid residues and wherein the base stock has a viscosity of from 3 cSt to 20 cSt at 100° C.

23. The ester base stock of claim 19 wherein said oligoester comprises a dimer acid ester of diethylene glycol.

24. The ester base stock of claim 19 further comprising an additive selected from the group consisting of extreme pressure additives, anti-foaming agents, pour point depressants, rust or corrosion prevention agents, oxidation inhibitors, detergent, dispersants, smoke-suppression agents, hydrocarbon diluents.

* * * * *